US006684862B2

(12) United States Patent
Oyama et al.

(10) Patent No.: US 6,684,862 B2
(45) Date of Patent: Feb. 3, 2004

(54) CONTROLLER FOR INTERNAL COMBUSTION ENGINE HAVING FUEL INJECTION SYSTEM

(75) Inventors: Katsuya Oyama, Hitachinaka (JP); Shoji Sasaki, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 111 days.

(21) Appl. No.: 10/101,207

(22) Filed: Mar. 20, 2002

(65) Prior Publication Data

US 2003/0062029 A1 Apr. 3, 2003

(30) Foreign Application Priority Data

Sep. 28, 2001 (JP) ..... 2001-302694

(51) Int. Cl.[7] ..... H01H 47/04; F02M 51/00
(52) U.S. Cl. ..... 123/490; 123/458; 361/154
(58) Field of Search ..... 123/458, 490; 361/154

(56) References Cited

U.S. PATENT DOCUMENTS

| | | | | |
|---|---|---|---|---|
| 5,941,216 | A * | 8/1999 | Arakawa | 123/490 |
| 6,453,876 | B1 * | 9/2002 | Fukutomi et al. | 123/490 |
| 6,532,940 | B1 * | 3/2003 | Ono et al. | 361/154 |
| 6,571,773 | B1 * | 6/2003 | Yamakado et al. | 361/154 |
| 2002/0189593 | A1 * | 12/2002 | Yamakado et al. | 123/490 |

FOREIGN PATENT DOCUMENTS

| | | |
|---|---|---|
| JP | 11-013519 | 1/1999 |
| JP | 11-343910 | 12/1999 |

* cited by examiner

*Primary Examiner*—Erick Solis
(74) *Attorney, Agent, or Firm*—Crowell & Moring LLP

(57) ABSTRACT

It is an object of the present invention to provide a controller for an internal combustion engine having a fuel injection system, which can realize an optimum injection even with a smaller inductance of a solenoid due to a smaller fuel injection valve (injector) and has a good property of minimum amount of fuel injection. A controller for an internal combustion engine having a fuel injection system with a solenoid comprising: a means for detecting an operating condition of the internal combustion engine; a means for calculating a fuel injection pulse width according to the above described detected operation condition; and a solenoid control means, wherein the above described solenoid control means includes, a means for supplying the above described solenoid a valve-opening current up to a large predetermined current value according to the above described calculated fuel injection pulse width; a means for supplying the solenoid a holding current for holding a valve opening state, after the above described valve-opening current has reached the predetermined current value; and a current waveform control means for forming a plurality of different current waveforms to be supplied to the above described solenoid and switching between the different current waveforms according to the above described detected operating condition.

14 Claims, 7 Drawing Sheets

CONTROLLER FOR INTERNAL COMBUSTION ENGINE HAVING FUEL INJECTION SYSTEM

BACKGROUND OF THE INVENTION

1. Field of the Invention

The present invention relates to a controller for an internal combustion engine, more particularly to a controller for controlling a waveform of a current supplied to a solenoid in the internal combustion engine which has a fuel injection system with the solenoid.

2. Prior Art

Conventionally, a fuel injection valve (injector) which injects the fuel into the combustion chamber of the internal combustion engine includes therein a plunger, a solenoid for energizing the plunger in a valve opening direction, and a spring for energizing the plunger in a valve closing direction. The fuel injection valve is supplied with a high fuel pressure which energizes the plunger in a valve opening direction.

The solenoid (injector) is supplied with a driving current which is generated by a battery and has a single waveform of current. A fuel injection from the fuel injection valve into the combustion chamber of the internal combustion engine is controlled by the driving current of the single waveform. The driving current is supplied to the solenoid in response to a signal applied to the solenoid in the fuel injection valve from a controller.

For example, Japanese Application Patent Laid-open Publication No. Hei 11-13519 and Japanese Application Patent Laid-open Publication No. Hei 11-343910 disclose a solenoid supply control for the fuel injection from the fuel injection valve. In the control, the driving current for the fuel injection valve (injector) has a single waveform having two current stages consisting of one stage of a valve opening signal and one stage of a holding current. A fuel injection pulse width is changed by the driving current according to the operating condition of the internal combustion engine. Thus, the amount of the fuel injection into the combustion chamber of the internal combustion engine is controlled to control the combustion in the internal combustion engine.

Recently, the fuel injection valve (injector) mounted in the internal combustion engine has been strongly required to be smaller to meet the various demands. However, a smaller fuel injection valve (injector) will result in a smaller inductance of the solenoid included in the fuel injection valve (injector). Thus, the solenoid may generate a smaller magnetmotive force with the above described conventional current of a single waveform applied to the solenoid and may generate a smaller suction force of the plunger in the fuel injection valve (injector). In particular, when a fuel is provided at a higher pressure, the solenoid may sometimes not generate a sufficient magnetmotive force for the suction of the plunger and the fuel injection valve may not inject the fuel.

It is also very important how minimum amount of fuel the injection valve (injector) can inject per injection, in other words, the property of minimum amount of fuel per injection of the fuel injection valve. The property of minimum amount of fuel is particularly required in the stratified charge lean combustion and is very important for the fuel efficiency and emission characteristics.

SUMMARY OF THE INVENTION

It is an object of the present invention to provide a controller for an internal combustion engine having a fuel injection system, which can realize an optimum injection even with a smaller inductance of a solenoid due to a smaller fuel injection valve (injector) and has a good property of minimum amount of fuel injection.

To achieve the above described object, a controller of the internal combustion engine according to the present invention is basically a controller for an internal combustion engine having a fuel injection system with a solenoid comprising: a detection system for detecting an operating condition of the internal combustion engine; a means for calculating a fuel injection pulse width according to the above described detected operation condition; and a solenoid control means, wherein the above described solenoid control means comprises, a means for supplying the above described solenoid a valve-opening current up to a large predetermined current value according to the above described calculated fuel injection pulse width; a means for supplying the solenoid a holding current for holding a valve opening state, after the above described valve-opening current has reached the predetermined current value; and a current waveform control means for forming a plurality of different current waveforms to be supplied to the above described solenoid and switching between the different current waveforms according to the above described detected operating condition.

According to one specific aspect of the present invention, the solenoid control means comprises, a boost circuit for boosting power from a battery; a first switching circuit for supplying the power from the above described boost circuit to the above described solenoid; a second switching circuit for supplying the power from the above described battery to the above described solenoid; a third switching circuit for sinking current from the above described solenoid to the ground; and a flywheel circuit for cycling current from the ground through the above described solenoid and the above described third switching circuit to the ground when the above described first switching circuit and the above described second switching circuit are off.

According to another specific aspect of the present invention, the above described plurality of current waveforms supplied to the above described solenoid have three types of current waveforms consisting of a first current waveform having one stage of a valve-opening current and two stages of a holding current; a second current waveform having one stage of a valve-opening current and one stage of a holding current; and a third current waveform having one stage of a valve-opening current and one stage of a holding current, the third current waveform being different from the above described second current waveform.

The controller for an internal combustion engine configured as described above according to the present invention can optimally control the injector even with a smaller inductance of the solenoid in the above described injector due to the smaller size of the injector and can hold a good property of minimum amount of fuel.

According to another specific aspect of the present invention, the above described current waveform control means forms the above described first current waveform by turning on the above described first switching circuit and the above described third switching circuit to supply a valve-opening current up to a large predetermined current value, then turning off the above described first switching circuit and turning on/off the above described second switching circuit to supply a large holding current which holds a valve opening state for a predetermined time using the above described flywheel circuit, and turning on/off the above described second switching circuit to supply a small holding current which holds a valve opening state for a predetermined time using the above described flywheel circuit.

According to still another specific aspect of the present invention, the above described current waveform control means forms the above described second current waveform by turning on the above described first switching circuit and the above described third switching circuit to supply a valve-opening current up to a large predetermined current value, and turning off the above described first switching circuit and turning on/off the above described second switching circuit to supply a small holding current which holds a valve opening state for a predetermined time using the flywheel circuit.

According to still another specific aspect of the present invention, the above described current waveform control means forms the above described third current waveform by turning on the above described first switching circuit and the above described third switching circuit to supply a valve-opening current up to a large predetermined current value, then turning off the above described first switching circuit and the above described third switching circuit to reduce switching time from the valve opening current to the holding current, and turning on the third switching circuit and turning on/off the above described second switching circuit to supply a small holding current which holds a valve opening state for a predetermined time using the flywheel circuit.

According to still another specific aspect of the present invention, the above described current waveform control means switches between at least two types of the three types of current waveforms supplied to the above described solenoid according to the detected operation condition of the above described internal combustion engine.

According to still another specific aspect of the present invention, the above described controller comprises a means for controlling a pressure of fuel supplied to the above described fuel injection system; and a means for detecting the above described fuel pressure, wherein the above described operating condition is indicated in the above described fuel pressure, and the above described controller comprises means for comparing the fuel injection pulse width calculated by the above described fuel injection pulse calculating means with a minimum effective fuel injection pulse width, and the above described operating condition is indicated in the above described comparison results, and the above described controller protects switching between the above described current waveforms supplied to the solenoid during the fuel injection.

According to still another specific aspect of the present invention, the above described controller comprises an arithmetic unit for determining the operating condition of the above described internal combustion engine, wherein the above described arithmetic unit and the above described current waveform control means are connected via serial communication.

DESCRIPTION OF THE INVENTION

A controller for an internal combustion engine having a fuel injection system according to one embodiment of the present invention will be described below in more detail with reference to the appended drawings.

Figure 1:
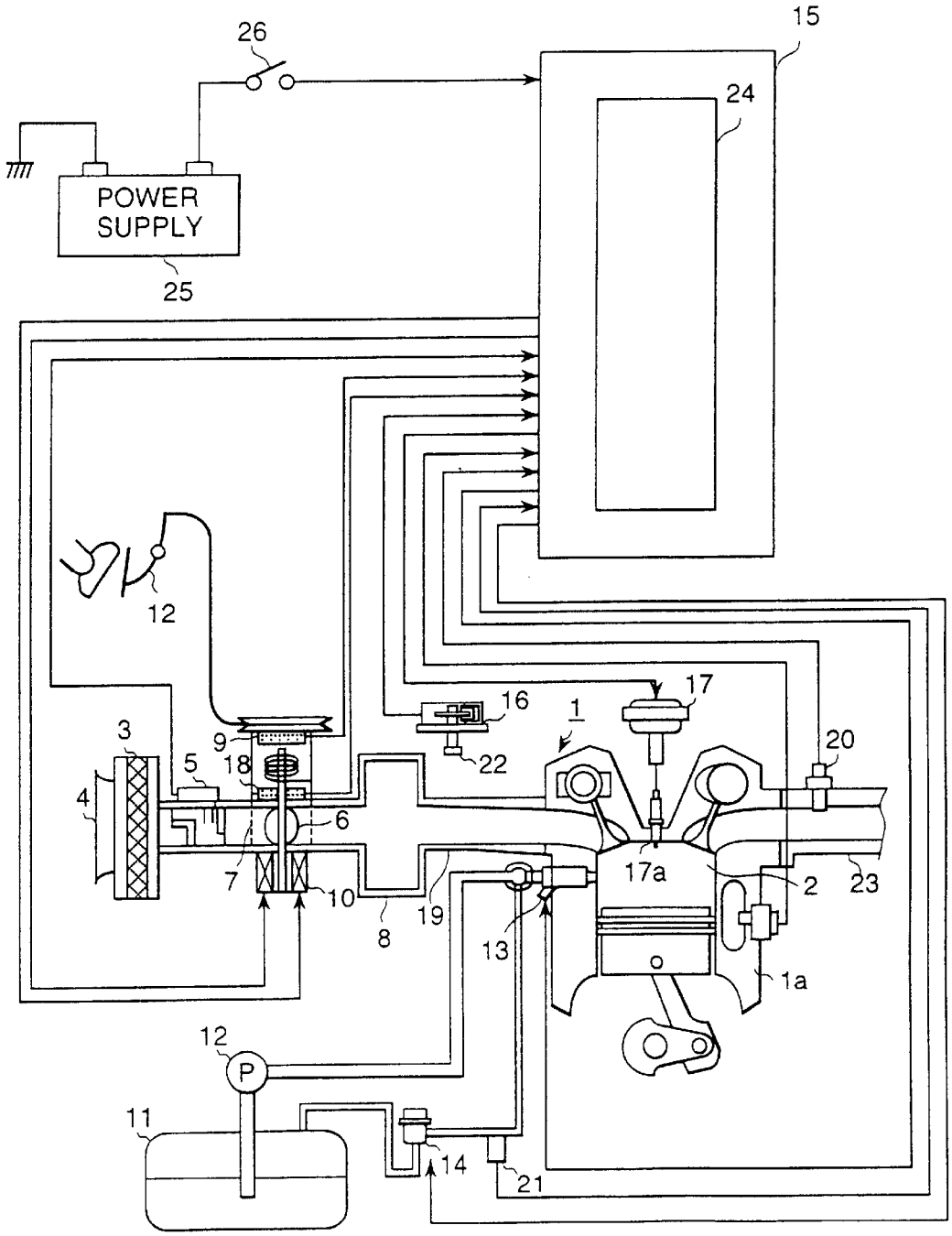
FIG. 1 shows an entire configuration of the control system of the internal combustion engine to which the controller for the internal combustion engine according to one embodiment of the present invention is applied.

FIG. 1 shows an entire configuration of an internal combustion engine system to which a controller of an internal combustion engine having a fuel injection system according to the present invention is applied. In FIG. 1, an internal combustion engine 1 is a multi-cylinder internal combustion engine which comprises a spark plug 17*a* fired by a ignition coil 17, a fuel injection valve (injector) 13 for injecting a fuel directly into the cylinder, and a fuel pump 12 for compressing and sending a fuel to the fuel injection valve 13 from a fuel tank 11. Each cylinder la of the internal combustion engine 1 is supplied with an intake air which enters an inlet 4 of an air cleaner 3, passing through an air meter (air-flow sensor) 5 which is one of measurement means for the operation condition of the internal combustion engine 1, a throttle body 7 containing a throttle valve 6 for the intake air flow control, and a collector 8.

After entering the collector 8, the intake air is distributed to an intake air pipe 19 connected to each cylinder 1*a* of the internal combustion engine 1 before entering a combustion chamber 2 of the cylinder 1*a*. The throttle valve 6 is connected to a motor 10. The motor 10 is driven to operate the throttle valve 6 for the intake air flow control. The combustion chamber 2 of the cylinder 1*a* emits a combustion exhaust gas which is released outside through an exhaust pipe 23.

The fuel such as a gasoline from the fuel tank 11 is sucked and compressed by the fuel pump 12. The fuel is then regulated at a predetermined pressure by a variable fuel pressure regulator 14. The fuel is then injected into the combustion chamber 2 of each cylinder 1*a* from the injector 13. The injector 13 exposes its fuel injection nozzle to the combustion chamber 2.

The variable fuel pressure regulator 14 is controlled by a control unit 15. The air meter 5 sends a signal indicative of the intake air flow to the control unit 15. The throttle body 7 is provided with a throttle sensor 18. The sensor 18 detects the opening of the throttle valve 6 and sends the detection signal to the control unit 15.

The internal combustion engine 15 also has a crank angle sensor 16. The crank angle sensor 16 is rotated by a camshaft 22 and sends a signal indicative of the rotational position of the crankshaft to the control unit 15. The exhaust pipe 23 has a A/F (Air Fuel Ratio) sensor 20. The A/F (Air Fuel Ratio) sensor 20 detects the air fuel ratio in actual driving according to the constituents of the exhaust gas in the exhaust pipe 23. The A/F sensor 20 sends the detection signal to the control unit 15. The throttle body 7 has an integrated acceleration sensor 9 which is connected to an acceleration pedal 12. The acceleration sensor 9 detects the operating amount of the driver on the acceleration pedal 12 and sends the detection signal to the control unit 15.

The control unit 15 has a processing means (CPU) 24. The processing means 24 receives input signals from, for example, several sensors for detecting the operation condition of the internal combustion engine such as the above described crank angle signal and acceleration opening signal. The processing means 24 then performs an operation on the signals and sends predetermined control signals to the above described injector 13, ignition coil 17, and motor 10 for operating the throttle valve 6 and thus controls the fuel supply, ignition timing, and intake air flow. The variable fuel pressure regulator 14 in the fuel system has an adjacent fuel pressure sensor 21. The fuel pressure sensor 21 sends a signal to the control unit 15. Between the power supply (battery) 25 and the control unit 15, is provided an ignition switch 26.

The injector 13 injects the fuel into the combustion chamber 2 of the cylinder la as described above. The injector 13 includes therein a plunger (not shown), a solenoid for energizing the plunger in a valve opening direction (see FIG. 2), and a spring for energizing the plunger in a valve closing direction. The injector 13 is supplied with a very high fuel pressure which also energizes the plunger in a valve opening direction.

Figure 2:
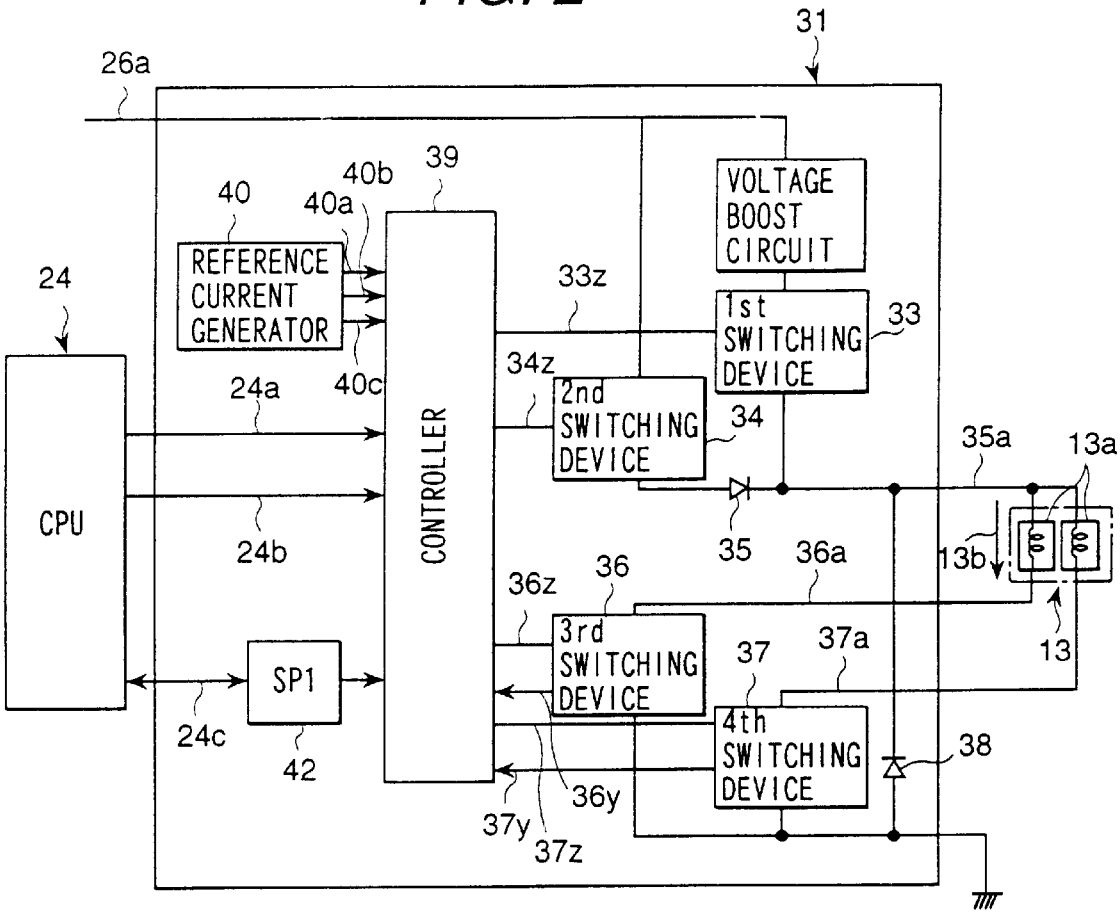
FIG. 2 shows a configuration of the solenoid control circuit of the controller of the internal combustion engine in FIG. 1.

FIG. 2 shows a configuration of the control circuit of the injector 13 in the control unit 15. The control circuit 31 (solenoid control means) for the solenoid 13*a* in the injector 13 has a circuits group. The circuits group comprises a boost circuit 32 for generating a higher voltage than the battery voltage 26*a*, a power from the battery 25.

In the normal operation, the opening of the injector 13 needs a large magnetmotive force of the solenoid 13*a*. With the typical power supply from the battery, the force of the solenoid 13*a* is insufficient to open the injector 13. Thus, the above described boost circuit 32 is needed.

A first switching device 33 controls a supply and interruption of a current to apply the boosted voltage 32*a* generated at the boost circuit 32 to the injector 13 (solenoid 13*a*). A second switching device 34 controls a supply and interruption of the current to apply the power 26*a* from the battery 26 to the injector 13.

The power supply (current) from the first switching device 33 and second switching device 34 are wired OR on a signal line 35*a*. The voltages on the line 35*a* have a relationship of the boosted voltage 32*a*>the battery voltage 26*a*, so that the boosted voltage 32*a* may flow into the battery 25 through the switching devices 33, 34. Thus, a current backflow prevention device 35 is provided between the signal line 35*a* and the second switching device 34.

Third and forth switching devices 36, 37 sink the current from the injector 13 to the ground and are provided for each injector separately. A feedback device 38 is for making a flywheel circuit which cycles the current across the injector 13 through the third switching device 36 (or the forth switching device 37)→the ground→feedback device 38→injector 13.

In FIG. 2, the above described first switching device 33, second switching device 34, current backflow prevention device 35, and feedback device 38 are provided for each couple of the opposed cylinders of the injector 13. However, in some applications, the above described first switching device 33, second switching device 34, current backflow prevention device 35, and feedback device 38 are provided for each injector 13 separately.

A reference current generator 40 sets a reference current for the injector 13. The reference current is set at three levels of a valve opening current 40*a*, holding current 40*b*, and holding current 40*c*.

A controller 39 controls the above described switching devices 33, 34, 36, and 37. The controller 39 selects one of the three reference currents 40*a*, 40*b*, and 40*c* according to the stage of the current supply to the injector 13 and switches to the selected current.

The interface between the CPU 24 and the solenoid control circuit 31 consists of parallel inputs 24*a*, 24*b*, and serial communication 24*c*. Through the parallel inputs, the CPU 24 sends the valve opening signal 24*a* and holding signal 24*b* to the controller 39 according to the fuel injection pulse width calculated in the CPU 24. Through the serial communication 24*c*, the CPU 24 communicates with a serial peripheral interface (SPI) 42 in the solenoid control circuit 31 to switch between the injector driving current waveforms in the controller 39. The controller 39, SPI 42, and the reference current generator 40 are collectively called a current waveform control means.

Figure 3:
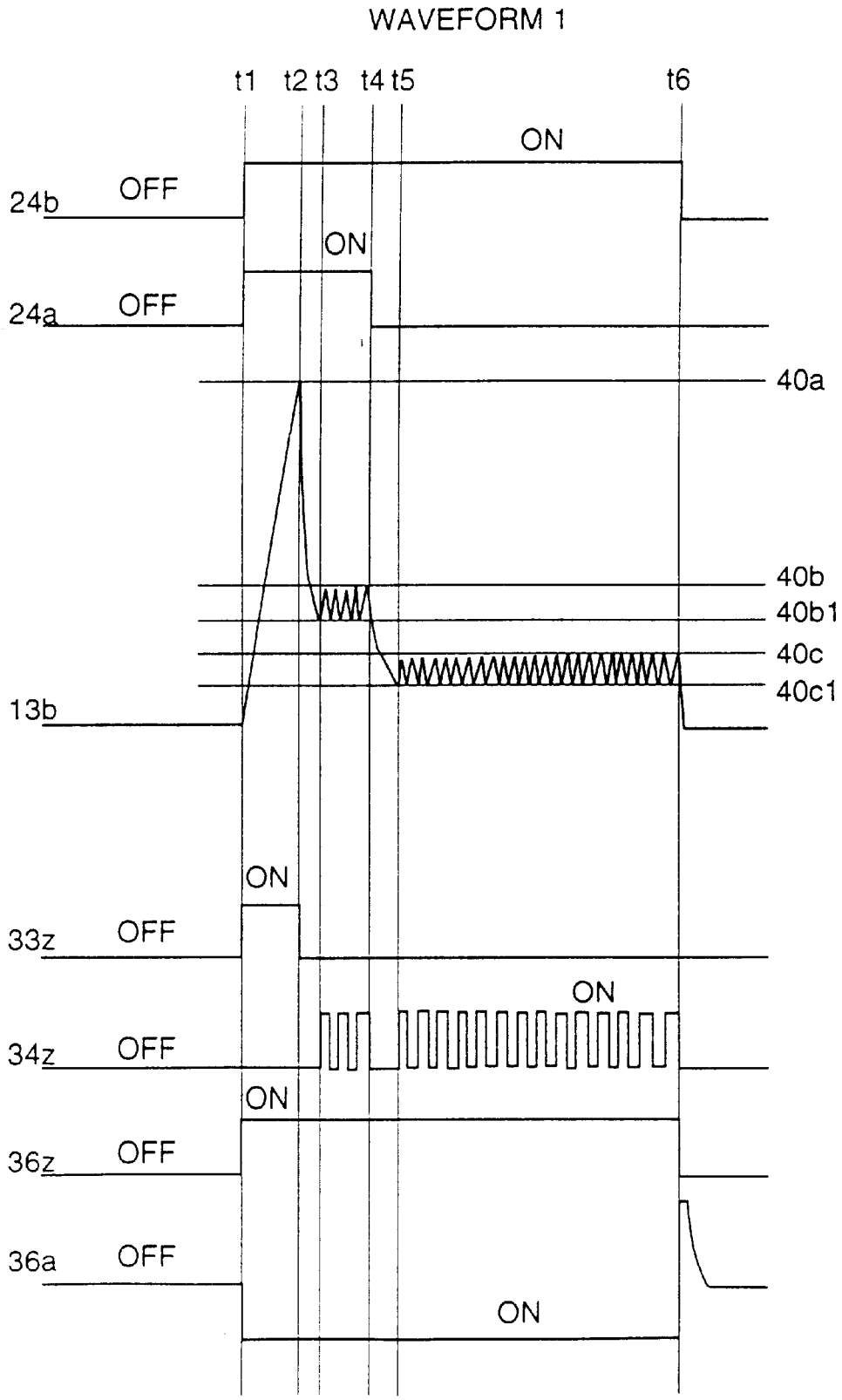
FIG. 3 shows a first current wave of the injector driving generated by the solenoid control circuit in FIG. 2.
Figure 4:
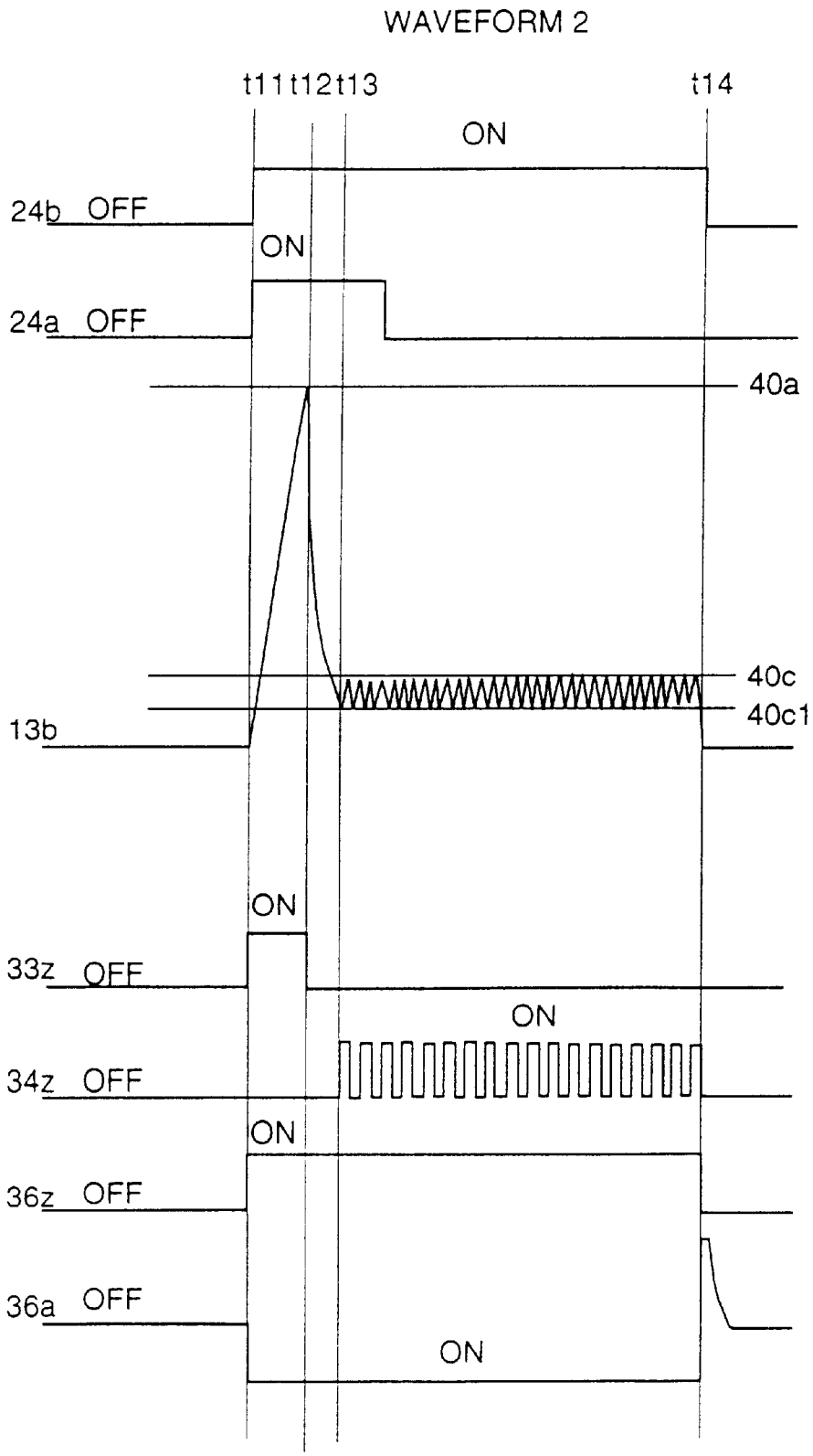
FIG. 4 shows a second current wave of the injector driving generated by the solenoid control circuit in FIG. 2.
Figure 5:
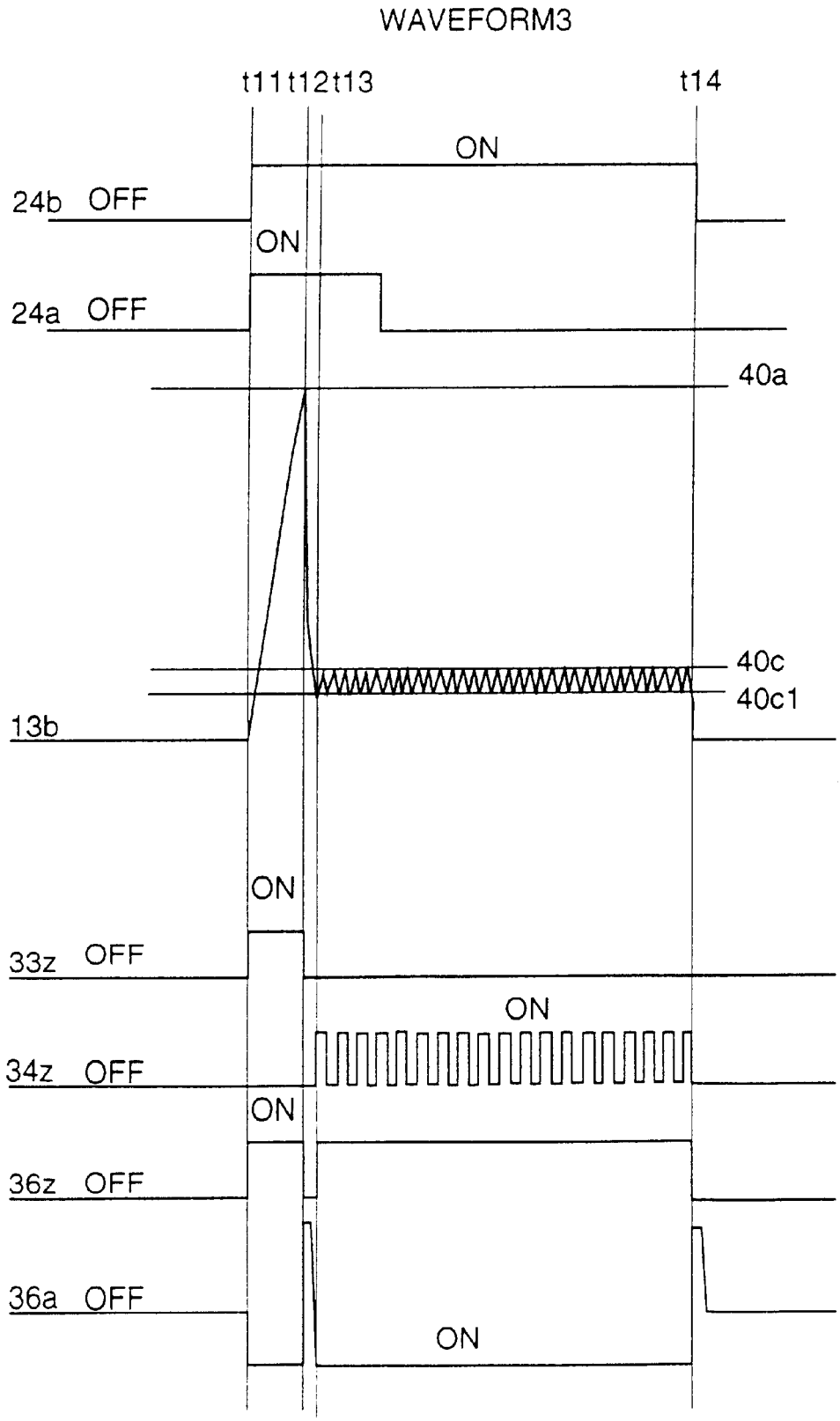
FIG. 5 shows a third current wave of the injector driving generated by the solenoid control circuit in FIG. 2.

FIGS. 3–5 show the control signals for each component to drive and control the injector 13 (solenoid 13*a*), and the injector driving current waveforms (solenoid current waveforms). As shown in FIGS. 3–5, the injector driving current waveforms (solenoid current waveforms) have three types of waveforms 1–3. The CPU can switch between the waveforms 1–3 via the SPI communication according to the operating condition. Now, the injector driving current waveform (solenoid current waveform) 13*b* shown in FIG. 2 will be described. Following description will be given for the third switching device 36 for sinking the current, although the same description can be applied to the forth switching device 37 for sinking the current.

The waveform 1 in FIG. 3 has a valve opening current and two stages of a holding current as shown by the injector driving current waveform 13*b*. Timing t1 is a timing when the injector 13 starts the fuel injection. When a logical AND between the valve opening signal 24*a* and the holding signal 24*b* from the CPU 24 is performed, the first switching device 33 and third switching device 36 are turned on, and the injector driving current 13*b* flows through the first switching device 33→the injector 13→the third switching device 36→the ground, and the driving current 13*b* for valve opening is supplied to the injector 13 up to a predetermined current value 40*a* to open the injector 13.

At this time, the injector driving current 13*b* is detected by a current detection device provided in the third switching device 36.

The detected current value 36*y* is compared with the reference value 40*a* of the valve opening current. The first switching device 33 and third switching device 36 are controlled by the control signal 33*z* and 36*z* from the controller, respectively.

At timing t2 when the predetermined current value 40*a* is reached, the first switching device 33 is turned off so that the injector driving current 13*b* reduces with flowing through a current loop of the injector 13→the third switching device 36→the ground→the feedback device 38→the injector 13.

At timing t3 when the injector driving current 13*b* reduces to a predetermined current value 40*b*1, the second switching device 34 is turned on by a control signal 34*z* from the controller 39. Then the injector driving current 13*b* flows through the second switching device 34→the current backflow prevention device 35→the injector 13→the third switching device 36→the ground. The second switching device 34 is left on until the injector driving current 13*b* reaches a predetermined current value 40*b*. At this time, the injector driving current 13*b* is detected by a current detection device provided in the third switching device 36. The detected current value 36*y* is compared with the reference vale 40*b* of the holding current 1 and the hiss reference value 40*b*1 of the holding current 1 which is determined by the reference current 40*b* of the holding current 1.

During the period of t3–t4 before the valve opening signal 24*a* is turned off, the above described second switching device 34 is repeatedly turned on/off to perform a constant current control of the injector driving current 13*b* within a predetermined current value of 40*b*1–40*b*. The controlled constant current value according to the present embodiment is set as to increase the suction force when the valve opening current can not open the injector 13 for the higher fuel pressure. The constant current value is set at a relatively large value to increase the magnetmotive force of the solenoid 13*a* in the injector 13 and open the injector 13.

At timing t4 when the valve opening signal 24*a* is turned off so that the controlled constant current value decreases to the extent of holding the opening state of the injector 13. At timing t4, in other words, when the valve opening signal 24*a* is turned off, the second switching device 34 is turned off. Then the injector driving current 13*b* reduces with flowing through the current loop of the injector 13 the third switching device 36→the ground→the feedback device 38→the injector 13.

At timing t5 when the injector driving current 13*b* reduces to a predetermined current value 40*c*1, the second switching device 34 is turned on by a control signal 34*z* from the controller 39. Then the injector driving current 13*b* flows through the second switching device 34 the current backflow prevention device 35 the injector 13 the third switching device 36 the ground. The second switching device 34 is left on until the injector driving current 13*b* reaches a predetermined current value 40*c*. At this time, the injector driving current 13*b* is detected by a current detection device provided in the third switching device 36. The detected current value 36*y* is compared with the reference vale 40*c* of the holding current 2 and the hiss reference value 40*c*1 of the holding current 2 which is determined by the reference current 40*c* of the holding current. During the period of t5–t6 before the holding signal 24*b* is turned off, the above described second switching device 34 is repeatedly turned on/off to perform a constant current control of the injector driving current 13*b* within a predetermined current value of 40*c*1–40*c*.

At timing t6 when the holding current 24*b* is turned off, the injector driving current 13*b* is interrupted and the fuel injection is stopped. At timing t6, the second switching device 34 and third switching device 36 are turned off, that is to say, both switching devices for controlling the current flows upstream and downstream to the injector 13 are stopped. Thus, the injector driving current 13*b* quickly reduces and the fuel injection from the injector 13 stops in response to the holding signal 24*b*.

The waveform 2 in FIG. 4 has a valve opening current and one stage of the holding current as shown by the injector driving current waveform 13*b*. Timing t11 is a timing when the injector 13 starts the fuel injection. When the logical AND between the valve opening signal 24*a* and the holding signal 24*b* from the CPU is performed, the first switching device 33 and third switching device 36 are turned on, and the injector driving current 13*b* flows through the first switching device 33→the injector 13→the third switching device 36→the ground, and the valve opening current 13*b* is supplied to the injector 13 up to a predetermined current value 40*a* to open the injector 13. At this time, the injector driving current 13*b* is detected by a current detection device provided in the third switching device 36. The detected current value 36*y* is compared with the reference value 40*a* of the valve opening current.

At timing t12 when the predetermined current value 40*a* is reached, the first switching device 33 is turned off so that the injector driving current 13*b* reduces with flowing through a current loop of the injector 13 the third switching device 36 the ground the feedback device 38 the injector 13.

At timing t13 when the injector driving current 13*b* reduces to a predetermined current value 40*c*1, the second switching device 34 is turned on by a control signal 34*z* from the controller 39. Then the injector driving current 13*b* flows through the second switching device 34→the current backflow prevention device 35→the injector 13→the third switching device 36→the ground. The second switching device 34 is left on until the injector driving current 13*b* reaches a predetermined current value 40*c*. At this time, the injector driving current 13*b* is detected by a current detection device provided in the third switching device 36. The detected current value 36*y* is compared with the reference vale 40*c* of the holding current 2 and the hiss reference value 40*c*1 of the holding current 1 which is determined by the reference current 40*c* of the holding current 2. During the period of t13–t14 before the holding signal 24*b* is turned off, the above described second switching device 34 is repeatedly turned on/off to perform a constant current control of the injector driving current 13*b* within a predetermined current value of 40*c*1–40*c*. The controlled constant current value according to the present embodiment is set in the same way as during the period of t5–t6 in FIG. 3, that is to say, to hold the opening state of the injector 13.

At timing t14 when the holding current 24*b* is turned off, the injector driving current 13*b* is interrupted and the fuel injection is stopped. At timing t14, the second switching device 34 and third switching device 36 are turned off, that is to say, both switching devices for controlling the current flows upstream and downstream to the injector 13 are stopped. Thus, the injector driving current 13*b* quickly reduces and the fuel injection from the injector 13 stops in response to the holding signal 24*b*.

In the waveform 2, the valve opening signal 24*a* is only used as a condition for allowing the start of the valve opening current. Thus, the valve opening signal 24*a* can have an off timing anytime during the period of t12–t14. The waveform 2 differs from the waveform 1 in that the waveform 2 does not have the holding current 1.

The waveform 3 in FIG. 5 has a valve opening current and one stage of the holding current as shown by the injector driving current waveform 13*b*. The waveform 3 differs from the waveform 2 in that the third downstream switching device 36 is turned off during switching from the valve opening current to the holding current.

Timing t21 is a timing when the injector 13 starts the fuel injection. When the logical AND between the valve opening signal 24*a* and the holding signal 24*b* from the CPU 24 is performed, the first switching device 33 and third switching device 36 are turned on, and the injector driving current 13*b* flows through the first switching device 33→the injector 13→the third switching device 36→the ground, and the injector driving current 13*b* is supplied to the injector 13 up to a predetermined current value 40*a* to open the injector 13. At this time, the injector driving current 13*b* is detected by a current detection device provided in the third switching device 36. The detected current value 36*y* is compared with the reference value 40*a* of the valve opening current. At timing t22 when the predetermined current value 40*a* is reached, the first switching device 33 and third switching device 36 are turned off so that the injector driving current 13*b* quickly reduces. At this time, the third switching device 36 has a loss of the injector driving current 13*b* between t22–t23×the voltage 36*a*. The injector driving current 13*b* is the valve opening current 40*a* which is large and causes a very large circuit loss.

At timing t23 when the injector driving current 13*b* reduces to a predetermined current value 40*c*1, the second switching device 34 and the third switching device 36 are turned on by the control signals 34*z*, 36*z* from the controller 39, respectively. Then the injector driving current 13*b* flows through the second switching device 34→the current back-flow prevention device 35→the injector 13→the third switching device 36→the ground. The second switching device 34 is left on until the injector driving current 13*b* reaches a predetermined current value 40*c*. At this time, the injector driving current 13*b* is detected by a current detection device provided in the third switching device 36. The detected current value 36*y* is compared with the reference vale 40*c* of the holding current 2 and the hiss reference value 40*c*1 of the holding current 1 which is determined by the reference current 40*c* of the holding current 2. During the period of t23–t24 before the holding signal 24*b* is turned off, the above described second switching device 34 is repeatedly turned on/off to perform a constant current control of the injector driving current 13*b* within a predetermined current value of 40*c*1–40*c*. The controlled constant current value according to the present embodiment is set in the same way as during the period of t5–t6 in FIG. 3 and the period of t13–t14 in FIG. 4, that is to say, to hold the opening state of the injector 13.

At timing t24 when the holding current 24*b* is turned off, the injector driving current 13*b* is interrupted and the fuel injection is stopped. At timing t24, the second switching device 34 and third switching device 36 are turned off, that is to say, both switching devices for controlling the current flows upstream and downstream to the injector 13 are stopped. Thus, the injector driving current 13*b* quickly reduces and the fuel injection from the injector 13 stops in response to the holding signal 24*b*.

In the waveform 3, as with the waveform 2, the valve opening signal 24*a* is only used as a condition for allowing the start of the valve opening current. Thus, the valve opening signal 24*a* can have an off timing anytime during the period of t22–t24. The waveform 3 differs from the waveform 2 in that the third downstream switching device 36 is turned off in switching from the valve opening current to the holding current.

As described above, the current waveforms 1–3 supplied to the injector 13 are described with reference to FIGS. 3–5, respectively.

Each waveform has merits and demerits.

The property of minimum effective fuel injection pulse width (Qmin property) is in the following order for each current waveform.

waveform 3>waveform 2>waveform 1

Thus, in the operation area where Qmin property is important, for example, for lower rotation rates of the internal combustion engine, the waveform 3 needs to be used for the injector control.

Suction force property of the plunger in the injector 13 is in the following order for each current waveform.

waveform 1>waveform 2=waveform 1

Thus, when a large suction force is necessary for the higher fuel pressure, the waveform s needs to be used for the injector control.

The circuit loss of the injector control circuit 31 is in the following order from lowest to highest for each waveform.

waveform 2>waveform 1>waveform 3

Thus, the waveform 2 results in the minimum circuit loss so that the waveform 2 of the injector driving current waveform is preferably used for the injector control, except in the above described operation area where the Qmin property is important and except when the large suction force is necessary for the higher fuel pressure. The waveform 2 is also necessary to decrease the total loss of the control unit 15.

As described above, the waveform of the injector driving current 13*b* is switched to the optimum waveform for each operation state to realize both the good property of the injector 13 and the lower loss of the injector control circuit 31.

Figure 6:
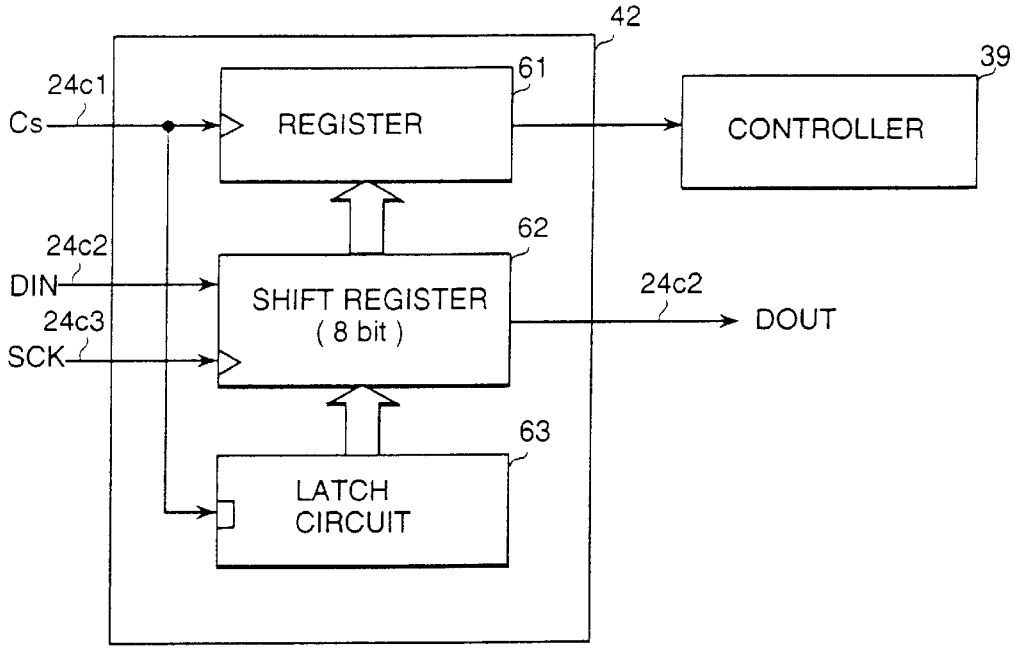
FIG. 6 shows an internal block diagram of the SPI in the solenoid control circuit in FIG. 2.

FIG. 6 shows an internal block diagram of the SPI communication 42 which switches the injector driving current 13*b* according to the present embodiment. The SPI communication line 24*c*, which is shown as one line in FIG. 2, has four lines of CS line 24*c*1, DIN line 24*c*2, SCK line 24*c*3, and DOUT line 24*c*4.

In the SPI communication, when a signal is input from the CS line 24*c*1 of the CPU 24 (the signal is LOW), the transmission and reception of the serial communication are performed between the CPU 24 and the SPI 42 in the injector controller 31. First, the signal input from the CS line 24*c*1 confirms 8 bit data which is previously stored in a latch circuit 63 and copy them to a shift register 62. In the present embodiment, the latch circuit 63 and the signal from the DOUT line 24*c*4 are not particularly described.

Then, the date is transmitted and received in response to signal on the SCK line 24*c*3 sent from the CPU 24. The serial communication between the CPU 24 and the SPI 42 consists of the 8 bit shift register 62. The signals from the DIN line 24*c*2 of the CPU 24 are stored in the register 62. At the same time, the transmission data stored in the shift register 62 is flushed as signals on the DOUT line 24*c*4 in response to the signal on the SCK line 24*c*3. These operations are performed every bit in synchronization with the rising or falling edge of the signals on the clock SCK line 24*c*3 from the CPU 24.

Then, the data stored in the shift register 62 is moved to the register 61 when the signals from the CS line 24*c*1 are completed (the signal is HIGH). At this time, the signals from the DIN line 24*c*2 include commands for switching between the injector driving currents waveforms. In the present embodiment, the 8 bit signals from the DIN line 24*c*2 include 2 bits to be able to switch among three type waveforms.

The controller 39 extracts the commands for switching among the injector driving current waveforms from the received signals from the DIN line 24*c*2. The controller 39 then controls the injector driving current 13*b* according to the commands. The above described SPI communication, which has been described as the 8 bit shift register, can consist of any bit shift register such as a 16 bit shift register.

Figure 7:
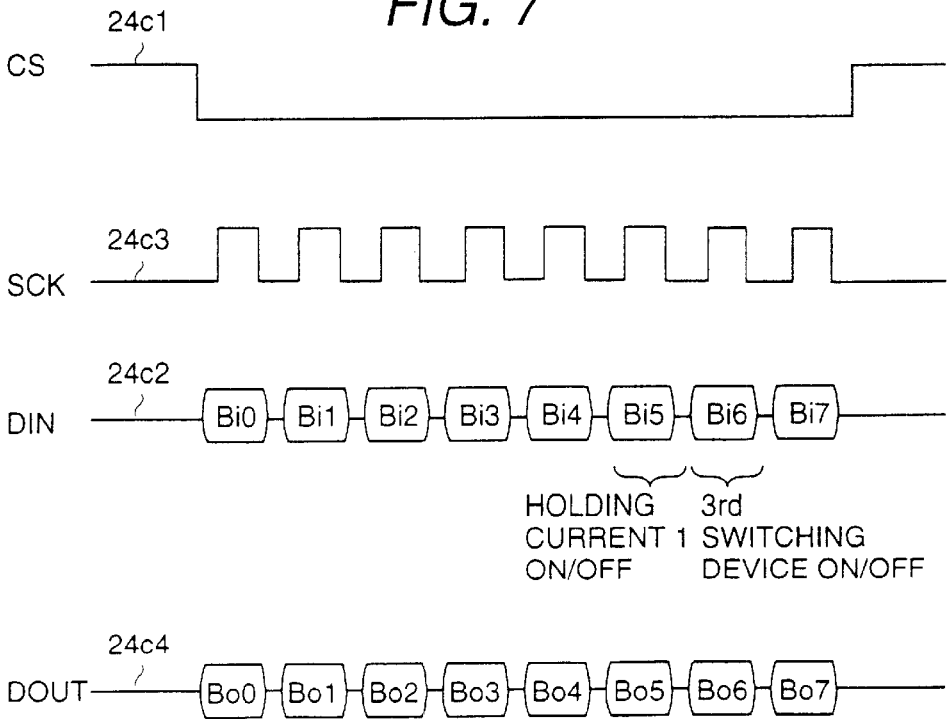
FIG. 7 shows a bit allocation map of the SPI in FIG. 6.

FIG. 7 shows a bit allocation map of the SPI communication.

In the present embodiment, the signals from the DIN line 24*c*2 are 8 bits data and 2 bits are allocated to the signals as bits for switching between the injector driving current waveforms. Bi 5 is a bit for switching between the holding current on and off. If Bi 5=1, the holding current is effective, and if Bi 5=0, the holding current is ineffective. That is to say, if Bi 5=0, the holding current has one stage.

Bi 6 is effective when the holding current 1 of the injector driving current waveforms is ineffective, in other words, Bi 5=0. If Bi 6=1, the turning off of the third switching device 36 during switching from the valve opening current to the holding current is effective. If Bi 6=0, the turning off of the third switching device 36 during switching from the valve opening current to the holding current is ineffective.

Thus, the injector driving current waveforms and the signals from the DIN line 24*c*2 have the following relationship.

Waveform 1: (Bi 5, Bi 6)=(1, *) * is Don't care.

Waveform 2: (Bi 5, Bi 6)=(0, 0)

Waveform 3: (Bi 5, Bi 6)=(0, 1)

Figure 8:
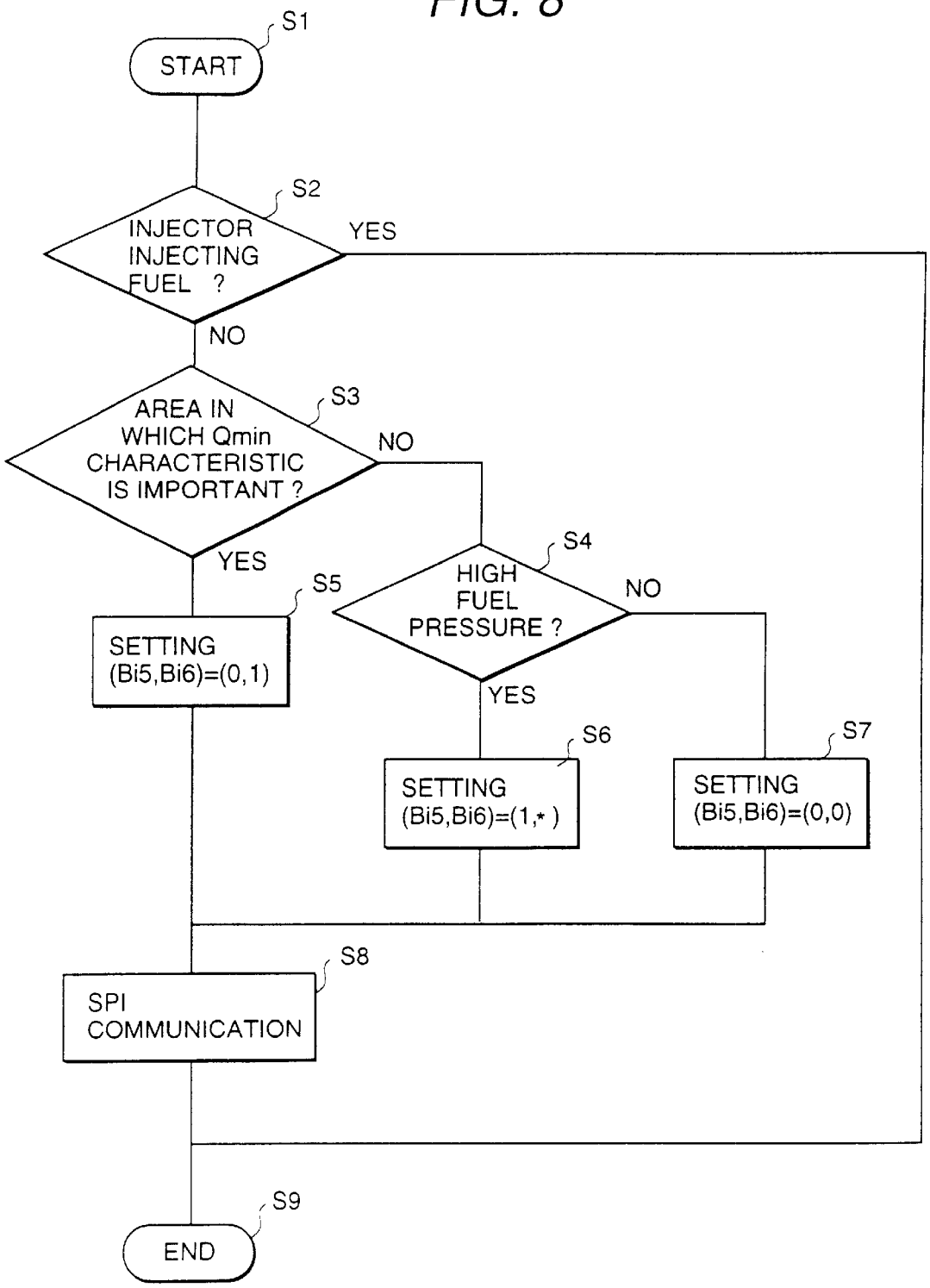
FIG. 8 shows a control flowchart of the controller of the internal combustion engine in FIG. 1.

FIG. 8 shows a flowchart of software in the CPU 24, which can realize a means for switching between the injector driving current waveforms according to the present embodiment.

The present task is generally a regular job which is, for example, performed every 10 ms. The 10 ms task is called, and started at START of step S1. At step S2, it is checked whether the injector is injecting at present. The switching between the injector driving current waveforms during the injection of the injector will result in an abnormal injection operation. Thus, the means for switching between the injector driving current waveforms is masked during the injection of the injector, in other word, jump to END of step S9.

At step S2, if it is checked that the injector is not injecting, jump to step S3. At step S3, it is checked whether the present operation condition of the internal combustion engine is in the area where the Qmin property is important. If the operation condition is in the area where the Qmin property is important, jump to step S5.

At step S5, (Bi 5, Bi 6)=(0, 1) is set to switch the injector driving current waveform to the waveform 3 in which the Qmin property is good.

At step S3, if the operation condition is not in the area where the Qmin property is important, jump to step S4. At step S4, it is checked whether the present operation condition of the internal combustion engine is under the higher fuel pressure. If the operation condition is under the higher fuel pressure, then jump to step S6.

At step S6, (Bi 5, Bi 6)=(1, *) is set to switch the injector driving current waveform to the waveform 1 in which the suction force property is good so that the injector can open for the higher fuel pressure. At step S4, if the operation condition is not under the higher fuel pressure, jump to step S7.

At step S7, (Bi 5, Bi 6)=(0, 0) is set to switch to the waveform 2 for the minimum circuit loss, because the operation condition is not in the area where the Qmin property is important or under the higher fuel pressure.

At step S8, the injector driving current waveforms which are set at the above described steps S5, S6, and S7 are sent to the injector control circuit 31 via the SPI communication. Thus, the injector driving current waveforms are set in the controller 39 via the SPI 42.

The amount of the fuel injection is determined according to the valve opening signal 24*a* and the pulse width of the holding signal 24*b* and the internal combustion engine 1 is optimally controlled.

Although one embodiment of the present invention has been described in detail above, the present invention is not intended to be limited to the embodiment and many modifications are possible in the design without departing from the spirit of the invention defined in the appended claims.

As understood from the above invention, a controller for an internal combustion engine having a fuel injection system according to the present invention can optimally control the injector even for a higher fuel pressure with a smaller inductance of the solenoid due to the smaller injector, and can keep a good property of minimum amount of fuel injection, and can also decrease the loss of the fuel supply system of the internal combustion engine.

What is claimed is:

1. A controller for an internal combustion engine having a fuel injection system with a solenoid comprising:

a means for detecting an operating condition of the internal combustion engine;

a means for calculating a fuel injection pulse width according to said detected operation condition; and a solenoid control means, wherein said solenoid control means comprises, a means for supplying said solenoid a valve-opening current up to a large predetermined current value according to said calculated fuel injection pulse width;

a means for supplying said solenoid a holding current for holding a valve opening state, after said valve-opening current has reached said predetermined current value; and a current waveform control means for forming a plurality of different current waveforms to be supplied to said solenoid and switching between said different current waveforms according to said detected operating condition.

2. A controller for an internal combustion engine according to claim 1, wherein said solenoid control means comprises, a boost circuit for boosting power from a battery;

a first switching circuit for supplying the power from said boost circuit to said solenoid;

a second switching circuit for supplying the power from said battery to said solenoid;

a third switching circuit for sinking current from said solenoid to the ground; and a flywheel circuit for cycling current from the ground through said solenoid and said third switching circuit to said ground when said first switching circuit and said second switching circuit are off.

3. A controller for an internal combustion engine according to claim 2, wherein said plurality of current waveforms supplied to said solenoid have three types of current waveforms consisting of a first current waveform having one stage of a valve-opening current and two stages of a holding current;

a second current waveform having one stage of a valve-opening current and one stage of a holding current; and a third current waveform having one stage of a valve-opening current and one stage of a holding current, said third current waveform being different from said second current waveform.

4. A controller for an internal combustion engine according to claim 3, wherein said current waveform control means forms said first current waveform by turning on said first switching circuit and said third switching circuit to supply a valve-opening current up to a large predetermined current value, then turning off said first switching circuit and turning on/off said second switching circuit to supply a large holding current which holds a valve opening state for a predetermined time using said flywheel circuit, and turning on/off said second switching circuit to supply a small holding current which holds a valve opening state for a predetermined time using said flywheel circuit.

5. A controller for an internal combustion engine according to claim 3, wherein said current waveform control means forms said second current waveform by turning on said first switching circuit and said third switching circuit to supply a valve-opening current up to a large predetermined current value, and turning off said first switching circuit and turning on/off said second switching circuit to supply a small holding current which holds a valve opening state for a predetermined time using said flywheel circuit.

6. A controller for an internal combustion engine according to claim 3, wherein said current waveform control means forms said third current waveform by turning on said first switching circuit and said third switching circuit to supply a valve-opening current up to a large predetermined current value, then turning off said first switching circuit and said third switching circuit to reduce switching time from the valve opening current to the holding current, and turning on said third switching circuit and turning on/off said second switching circuit to supply a small holding current which holds a valve opening state for a predetermined time using said flywheel circuit.

7. A controller for an internal combustion engine according to claim 3, wherein said current waveform control means switches between at least two types of said three types of current waveforms supplied to said solenoid according to said detected operation condition of said internal combustion engine.

8. A controller for an internal combustion engine according to claim 1, wherein said controller comprises a means for controlling a pressure of fuel supplied to said fuel injection system; and a means for detecting said fuel pressure, wherein said operating condition is indicated in said fuel pressure.

9. A controller for an internal combustion engine according to claim 1, wherein said controller comprises a means for comparing said fuel injection pulse width calculated by said fuel injection pulse calculating means with a minimum effective fuel injection pulse width, wherein said operating condition is indicated in said comparison results.

10. A controller for an internal combustion engine according to claim 1, wherein said controller protects switching between said current waveforms supplied to said solenoid during the fuel injection.

11. A controller for an internal combustion engine according to claim 1, wherein said controller comprises an arithmetic unit for determining the operating condition of said internal combustion engine, wherein said arithmetic unit and said current waveform control means are connected via serial communication.

12. A controller for an internal combustion engine according to claim 4, wherein said current waveform control means forms said second current waveform by turning on said first switching circuit and said third switching circuit to supply a valve-opening current up to a large predetermined current value, and turning off said first switching circuit and turning on/off said second switching circuit to supply a small holding current which holds a valve opening state for a predetermined time using said flywheel circuit.

13. A controller for an internal combustion engine according to claim 4, wherein said current waveform control means forms said third current waveform by turning on said first switching circuit and said third switching circuit to supply a valve-opening current up to a large predetermined current value, then turning off said first switching circuit and said third switching circuit to reduce switching time from the valve opening current to the holding current, and turning on said third switching circuit and turning on/off said second switching circuit to supply a small holding current which holds a valve opening state for a predetermined time using said flywheel circuit.

14. A controller for an internal combustion engine according to claim 13, wherein said current waveform control means forms said second current waveform by turning on said first switching circuit and said third switching circuit to supply a valve-opening current up to a large predetermined current value, and turning off said first switching circuit and turning on/off said second switching circuit to supply a small holding current which holds a valve opening state for a predetermined time using said flywheel circuit.

* * * * *